US010714833B2

(12) United States Patent
Tsou et al.

(10) Patent No.: US 10,714,833 B2
(45) Date of Patent: Jul. 14, 2020

(54) ANTENNA STRUCTURE AND WIRELESS COMMUNICATION DEVICE USING SAME

(71) Applicant: Chiun Mai Communication Systems, Inc., New Taipei (TW)

(72) Inventors: Tun-Yuan Tsou, New Taipei (TW); Shu-Wei Jhang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 8 days.

(21) Appl. No.: 16/184,065

(22) Filed: Nov. 8, 2018

(65) Prior Publication Data

US 2019/0190150 A1 Jun. 20, 2019

(30) Foreign Application Priority Data

Nov. 28, 2017 (CN) ..... 2017 1 1217005

(51) Int. Cl.

| | |
|---|---|
| ***H01Q 1/00*** | (2006.01) |
| ***H01Q 5/385*** | (2015.01) |
| ***H01Q 1/24*** | (2006.01) |
| ***H01Q 23/00*** | (2006.01) |
| ***H01Q 1/48*** | (2006.01) |
| ***H01Q 1/44*** | (2006.01) |

(52) U.S. Cl.

CPC ..... *H01Q 5/385* (2015.01); *H01Q 1/243* (2013.01); *H01Q 1/44* (2013.01); *H01Q 1/48* (2013.01); *H01Q 23/00* (2013.01)

(58) Field of Classification Search

None

See application file for complete search history.

(56) References Cited

U.S. PATENT DOCUMENTS

| | | | | |
|---|---|---|---|---|
| 9,478,860 | B2 * | 10/2016 | Lin | H01Q 9/0414 |
| 9,673,512 | B2 * | 6/2017 | Lin | H01Q 1/243 |
| 10,230,155 | B2 * | 3/2019 | Chih | H01Q 1/243 |
| 10,290,925 | B2 * | 5/2019 | Huang | H01Q 5/10 |
| 10,483,622 | B2 * | 11/2019 | Lee | H01Q 9/42 |
| 10,498,010 | B2 * | 12/2019 | Lin | H01Q 21/28 |
| 10,511,081 | B2 * | 12/2019 | Chen | H01Q 1/243 |
| 2015/0091755 | A1 * | 4/2015 | Chawgo | H01Q 1/246 342/359 |

(Continued)

FOREIGN PATENT DOCUMENTS

CN 105720382 A 6/2016

*Primary Examiner* — Trinh V Dinh

(74) *Attorney, Agent, or Firm* — ScienBiziP, P.C.

(57) ABSTRACT

An antenna structure utilizing metal housing of a wireless communication device as antenna includes first, second, and third metallic members, and a feed portion. A first gap is between the first and second metallic members. A second gap is between the second and third metallic members. The current feed portion is connected to the second metallic member, and current entering the second metallic member flows towards the first gap and the second gap respectively to excite radiation signals in a first frequency band. The first and third metallic members obtain the current by coupling and excite radiation signals in a second and a third frequency bands respectively. Frequencies of the third frequency band are higher than frequencies of the second frequency band, which are higher than the frequencies of the first frequency band. A wireless communication device using the antenna structure is provided.

20 Claims, 8 Drawing Sheets

(56) References Cited

U.S. PATENT DOCUMENTS

| | | | | |
|---|---|---|---|---|
| 2018/0026332 | A1* | 1/2018 | Lin | H01Q 1/521<br>343/872 |
| 2018/0026348 | A1* | 1/2018 | Lee | H01Q 5/10<br>455/575.5 |
| 2018/0026349 | A1* | 1/2018 | Lee | H01Q 5/10<br>455/575.7 |
| 2018/0248250 | A1* | 8/2018 | Hsu | H01Q 9/30 |
| 2018/0248264 | A1* | 8/2018 | Chen | H01Q 5/378 |
| 2019/0097319 | A1* | 3/2019 | Hsieh | H01Q 1/48 |
| 2019/0131694 | A1* | 5/2019 | Lee | H01Q 7/00 |
| 2019/0181554 | A1* | 6/2019 | Lee | H01Q 5/35 |
| 2019/0214721 | A1* | 7/2019 | Hu | H01Q 1/2266 |
| 2019/0372223 | A1* | 12/2019 | Hsu | H01Q 13/18 |

* cited by examiner

ANTENNA STRUCTURE AND WIRELESS COMMUNICATION DEVICE USING SAME

FIELD

The subject matter herein generally relates to an antenna structure and a wireless communication device using the antenna structure.

BACKGROUND

Metal housings, for example, metallic backboards, are widely used for wireless communication devices, such as mobile phones or personal digital assistants (PDAs). Antennas are also important components in wireless communication devices for receiving and transmitting wireless signals at different frequencies, such as wireless signals in Long Term Evolution Advanced (LTE-A) frequency bands. However, the metal housing can work against the antenna signals by shielding them. This can degrade the operation of the wireless communication device. Additionally, other metal elements in the metal housing and a limited space in the metal housing for placing the antenna may also affect the performance of the antenna.

Therefore, there is room for improvement in the art.

BRIEF DESCRIPTION OF THE DRAWINGS

Implementations of the present disclosure will now be described, by way of example only, with reference to the attached figures.

DETAILED DESCRIPTION

Figure 1:
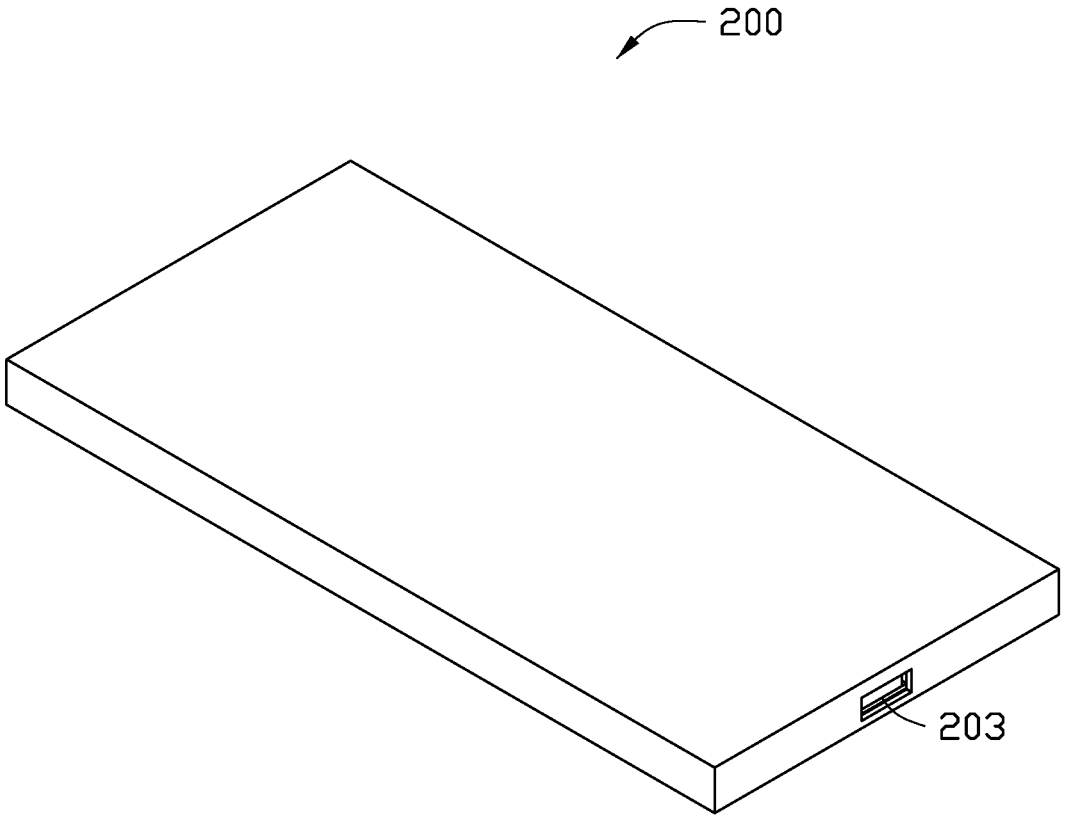
FIG. 1 is an isometric view of an embodiment of a wireless communication device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

Figure 2:
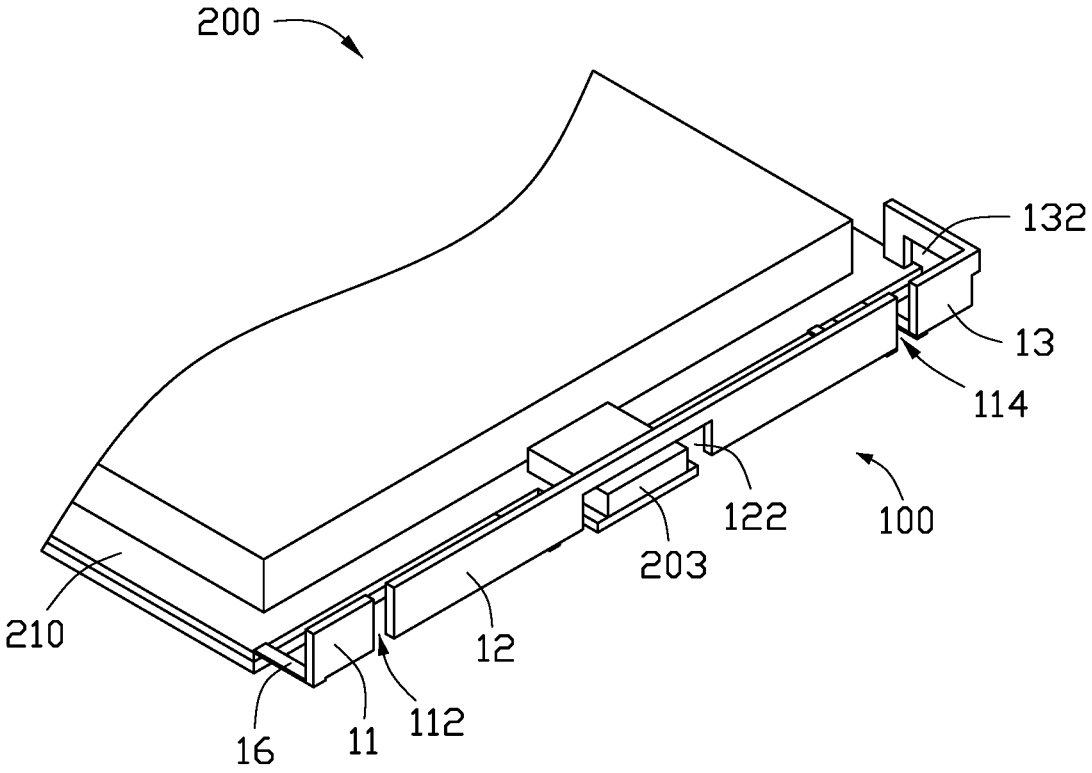
FIG. 2 is an isometric view of an embodiment of the wireless communication device employing an antenna structure.

FIGS. 1 and 2 show an embodiment of a wireless communication device 200 using a first antenna structure 100. The wireless communication device 200 can be a mobile phone or a personal digital assistant, for example. The antenna structure 100 can receive and send wireless signals.

Figure 3:
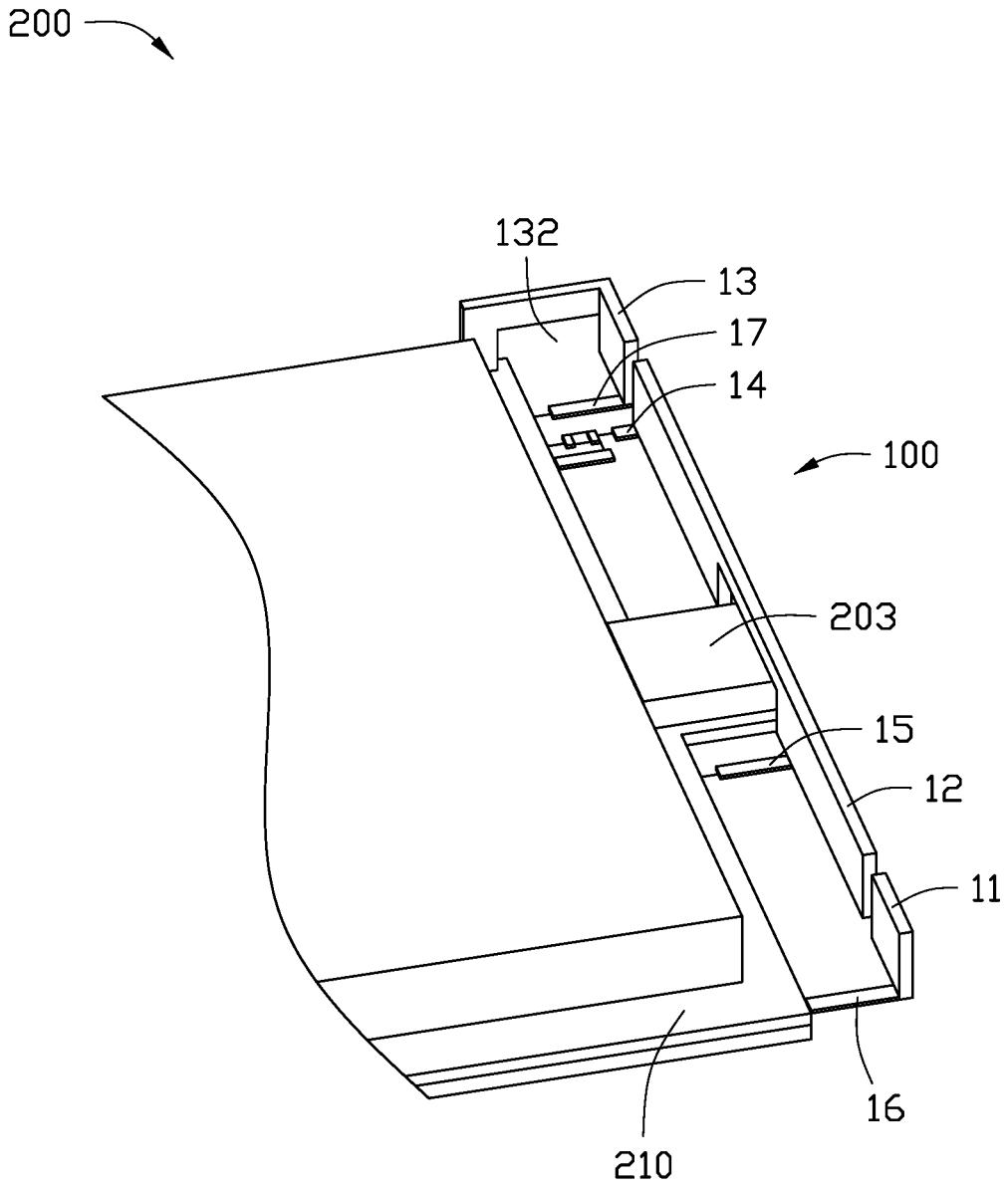
FIG. 3 is another isometric view of the wireless communication device employing the antenna structure of FIG. 2.
Figure 4:
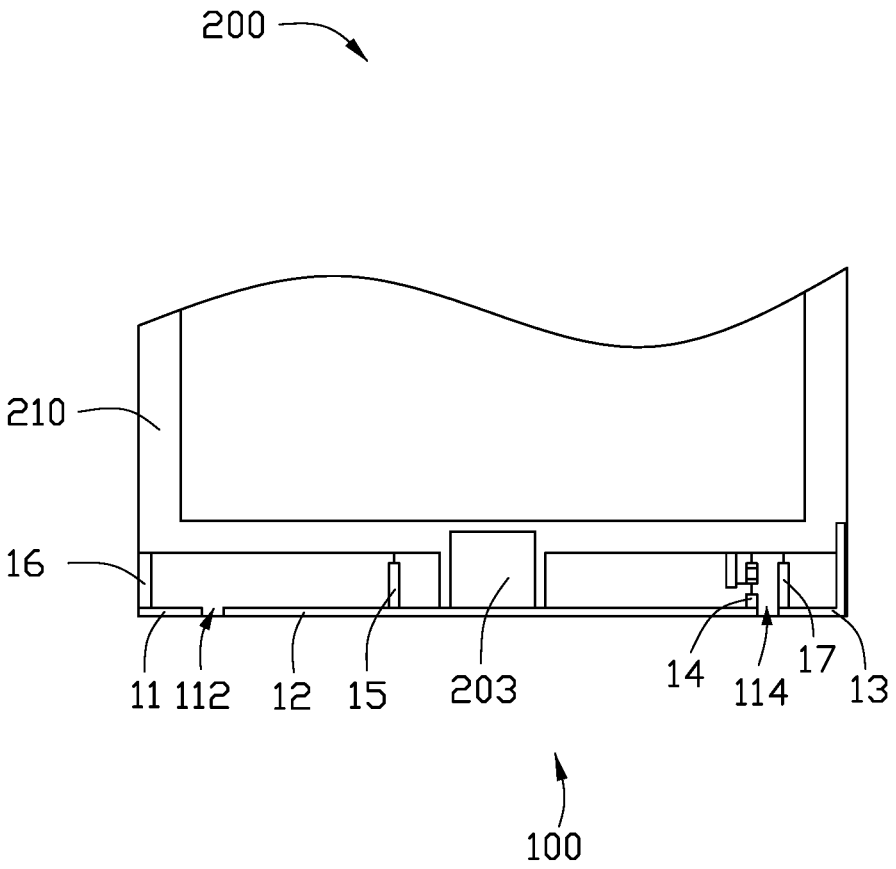
FIG. 4 is a planar view of the wireless communication device employing the antenna structure of FIG. 2.
Figure 5:
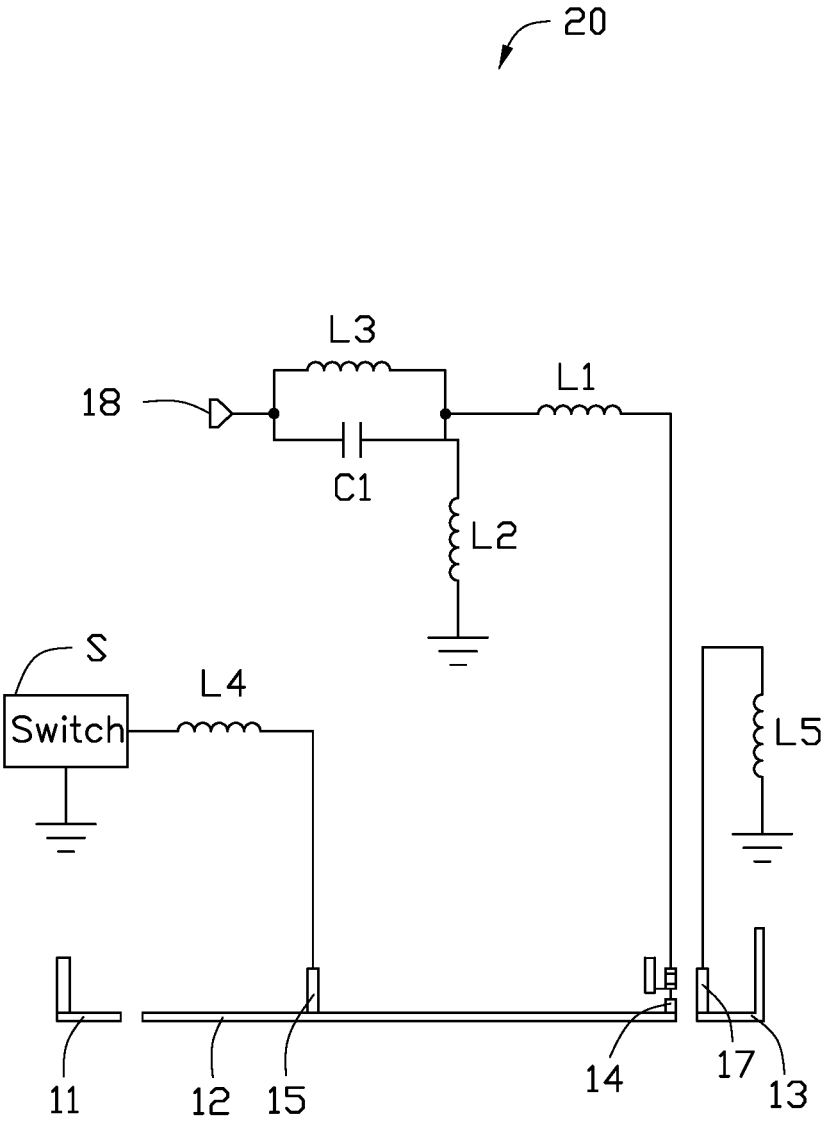
FIG. 5 is a circuit diagram of an embodiment of a switching circuit of the antenna structure.

Per FIGS. 2, 3, and 4, the antenna structure 100 includes a first metallic member 11, a second metallic member 12, a third metallic member 13, a feed portion 14, a first extending arm 15, a ground portion 16, a second extending arm 17, and a switching circuit 20 (shown in FIG. 5).

The first metallic member 11, the second metallic member 12, and the third metallic member 13 can be parts of a metal housing of the wireless communication device 200 or can be internal structures of the wireless communication device 200. In this embodiment, the first metallic member 11, the second metallic member 12, and the third metallic member 13 are a portion of an external frame structure of the wireless communication device 200. The fattest widths of each of the first metallic member 11, the second metallic member 12, and the third metallic member 13 can be equal to the thickness of the wireless communication device 200 from front to back. The crosswise direction of the first metallic member 11, the second metallic member 12, and the third metallic member 13 is the thickness direction of the wireless communication device 200. The lengthwise direction of the first metallic member 11, the second metallic member 12, and the third metallic member 13 can be the width direction of the wireless communication device 200.

The wireless communication device 200 includes a circuit board 210 and a USB (Universal Serial Bus) connector 203. The USB connector 203 is arranged in a middle portion of an end of the circuit board 210. The first metallic member 11, the second metallic member 12, and the third metallic member 13 are arranged on a middle portion of an end of the circuit board 210 and electrically connected to the circuit board 210. In at least one embodiment, the first metallic member 11, the second metallic member 12, and the third metallic member 13 are arranged in a bottom portion of the wireless communication device 200. The first metallic member 11 and the third metallic member 13 are in opposite ends of the bottom portion. The second metallic member 12 is in middle of the bottom portion of the wireless communication device 200. The first metallic member 11, the second metallic member 12, and the third metallic member 13 are substantially metallic sheets and are spaced apart from each other. A first gap 112 is formed between the first metallic member 11 and the second metallic member 12, and a second gap 114 is formed between the second metallic member 12 and the third metallic member 13.

The first metallic member 11 is substantially perpendicular to and spaced apart from the circuit board 210. An end of the ground portion 16 is perpendicularly connected to an end of the first metallic member 11 away from the second metallic member 12, another end of the ground portion 16 is electrically connected to a ground of the circuit board 210 for grounding the antenna structure 100. The second metallic member 12 is substantially perpendicular to and spaced apart from the circuit board 210. A middle portion of the second metallic member 12 defines a first opening 122, the USB connector 203 is exposed from the wireless communication device 200 through the first opening 122. An end of the feed portion 14 is perpendicularly connected to an end of the second metallic member 12 that is adjacent to the third metallic member 13, another end of the feed portion 14 is electrically connected to a feed source 18 (shown in FIG. 5) of the circuit board 210 through a switching circuit 20, for feeding current into the antenna structure 100. An end of the first extending arm 15 is perpendicularly connected to the second metallic member 12, the other end of the first extending arm 15 is electrically connected to the switching circuit 20. The first extending arm 15 is adjacent to and spaced from the USB connector 203. The third metallic member 13 is substantially L-shaped. In at least one embodiment, the third metallic member 13 extends along a bottom edge and a side edge of the wireless communication device 200. An end of the third metallic member 13 along the bottom edge is connected to ground of the circuit board 210 and further defines a second opening 132 which exposes other electronic elements (not shown). An end of the second extending arm 17 is perpendicularly connected to an end of the third metallic member 13 that is adjacent to the second metallic member 12, another end of the second extending arm 17 is connected to the ground of the circuit board 210.

In FIG. 5, the switching circuit 20 is electrically connected between the first metallic member 11, the second metallic member 12, the third metallic member 13, and the circuit board 210. The switching circuit 20 is arranged on the circuit board 210. The switching circuit 20 includes a first inductor L1, a second inductor L2, a third inductor L3, a fourth inductor L4, a fifth inductor L5, a capacitor C1, and a switch S. An end of the third inductor L3 is electrically connected to the feed source 18 of the circuit board 210, and another end of the third inductor L3 is electrically connected to an end of the first inductor L1. Another end of the first inductor L1 is electrically connected to the feed portion 14. The capacitor C1 and the third inductor L3 are connected in parallel. An end of the capacitor C1 is electrically connected to the feed source 18, another end of the capacitor C1 is electrically connected to the first inductor L1. An end of the second inductor L2 is electrically connected to a junction of the third inductor L3, the first inductor L1, and the capacitor C1. Another end of the second inductor L2 is electrically connected to ground. An end of the fourth inductor L4 is electrically connected to the first extending arm 15, another end of the fourth inductor L4 is electrically connected to ground through the switch S. An end of the fifth inductor L5 is electrically connected to the second extending arm 17, another end of the fifth inductor L5 is electrically connected to ground. In at least one embodiment, an inductance of the first inductor L1 is 8 nanohenry (nH), an inductance of the second inductor L2 is 16 nanohenry, and an inductance of the third inductor L3 is 7.5 nanohenry. The inductance of the fourth inductor L4 can be selectably switched between 20 nanohenry, 40 nanohenry, and 60 nanohenry by the switch S, an inductance of the fifth inductor L5 is 10 nanohenry, and a capacity of the capacitor C1 is 1.5 picofarad (pF).

The second metallic member 12 feeds in current from the feed source 18 of the circuit board 210. The current flows through the switching circuit 20 and the feed portion 14 and then enters the second metallic member 12, and flows towards the first gap 112 and the second gap 114, respectively. The current further flows into the first extending arm 15, thus exciting a first resonant mode to generate radiation signals in a first frequency band. In this embodiment, the first resonant mode is an LTE-A (Long Term Evolution Advanced) low frequency resonant mode, the first frequency band being a frequency band of about 700-960 MHz. The first metallic member 11 obtains current from the second metallic member 12 by coupling, the current flows through the first metallic member 11 and the ground portion 16, thus exciting a second resonant mode to generate radiation signals in a second frequency band. In this embodiment, the second resonant mode is an LTE-A middle frequency resonant mode, the second frequency band is a frequency band of about 1710-2170 MHz. The third metallic member 13 obtains current from the second metallic member 12 by coupling, the current flows through the third metallic member 13 and the second extending arm 17, thus exciting a third resonant mode to generate radiation signals in a third frequency band. In this embodiment, the third resonant mode is an LTE-A high frequency resonant mode, the third frequency band is a frequency band of about 2300-2690 MHz.

The inductance of the fourth inductor L4 can be varied by switching the switch S, thus the first frequency band of the second metallic member 12 can be adjusted. For example, the LTE-A low frequency band can be moved towards lower or higher frequencies within the range of 700-960 MHz. Additionally, the frequencies of the third frequency band of the third metallic member 13 are determined based on the fifth inductor L5. The second inductor L2 and the capacitor C1 form a high-pass matching circuit to broaden a bandwidth of the first frequency band. The frequencies of the second frequency band of the first metallic member 11 are determined based on the first inductor L1 and the third inductor L3.

In FIG. 4, a length of the wireless communication device 200 can be 142 millimeters, a width of the wireless communication device 200 can be 69 millimeters, and a thickness of the wireless communication device 200 from screen-side to backside can be 7.9 millimeters. To obtain preferred antenna characteristics, a length of the first metallic member 11 can be 6 millimeters, a length of the second metallic member 12 can be 50 millimeters, and a length of the third metallic member 13 along a short side of the wireless communication device 200 can be 6 millimeters, a length of the third metallic member 13 along a long side of the wireless communication device 200 can be 9 millimeters. Each of the first metallic member 11, the second metallic member 12, and the third metallic member 13 is at least 3 millimeters apart from the circuit board 210, that is, the width of the keep-out area of the antenna structure 100 can be 3 millimeters. A width of each of the gaps 112, 114 can be 2 millimeters, which may further improve antenna characteristic for the radiating sections. The width of each of the gaps 112 and 114 is in a range from 0.5 to 5 millimeters.

Figure 6:
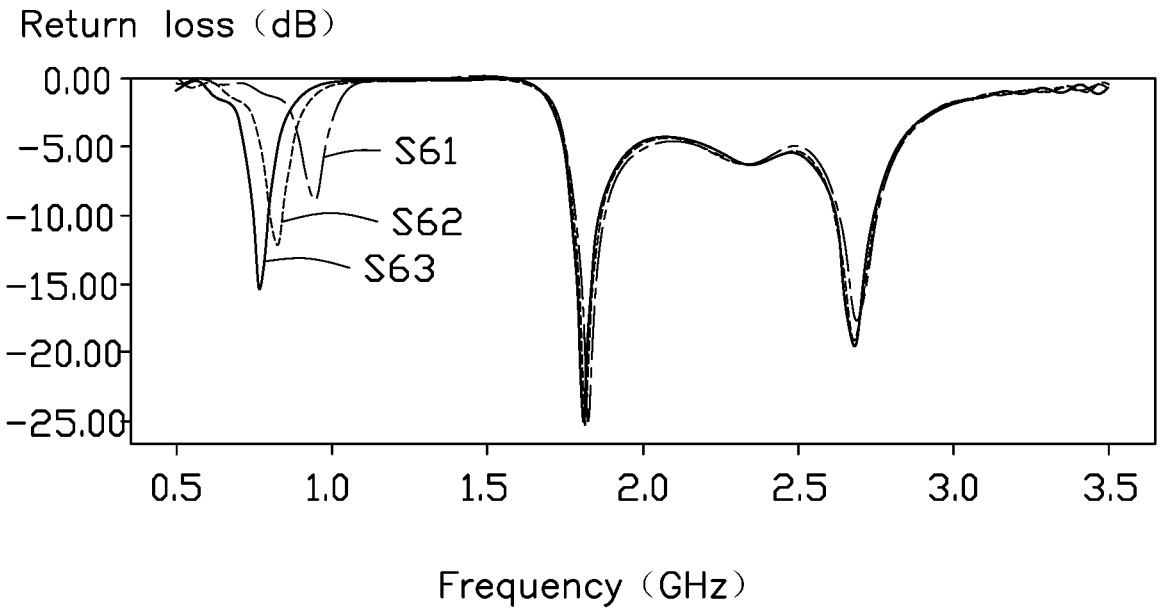
FIG. 6 is a return loss (RL) graph when the antenna structure of FIG. 2 is in operation.

FIG. 6 shows a return loss (RL) graph of the antenna structure 100 in operation. The fourth inductor L4 can be adjusted with different inductances by the switch S, thus performing the different frequency curves S61, S62, S63. Curve S61 is a return loss of the antenna structure 100 in operation when the inductance of the fourth inductor L4 is switched to 20 nH. Curve S62 is a return loss of the antenna structure 100 in operation when the inductance of the fourth inductor L4 is switched to 40 nH. Curve S63 is a return loss of the antenna structure 100 in operation when the inductance of the fourth inductor L4 is switched to 60 nH.

Figure 7:
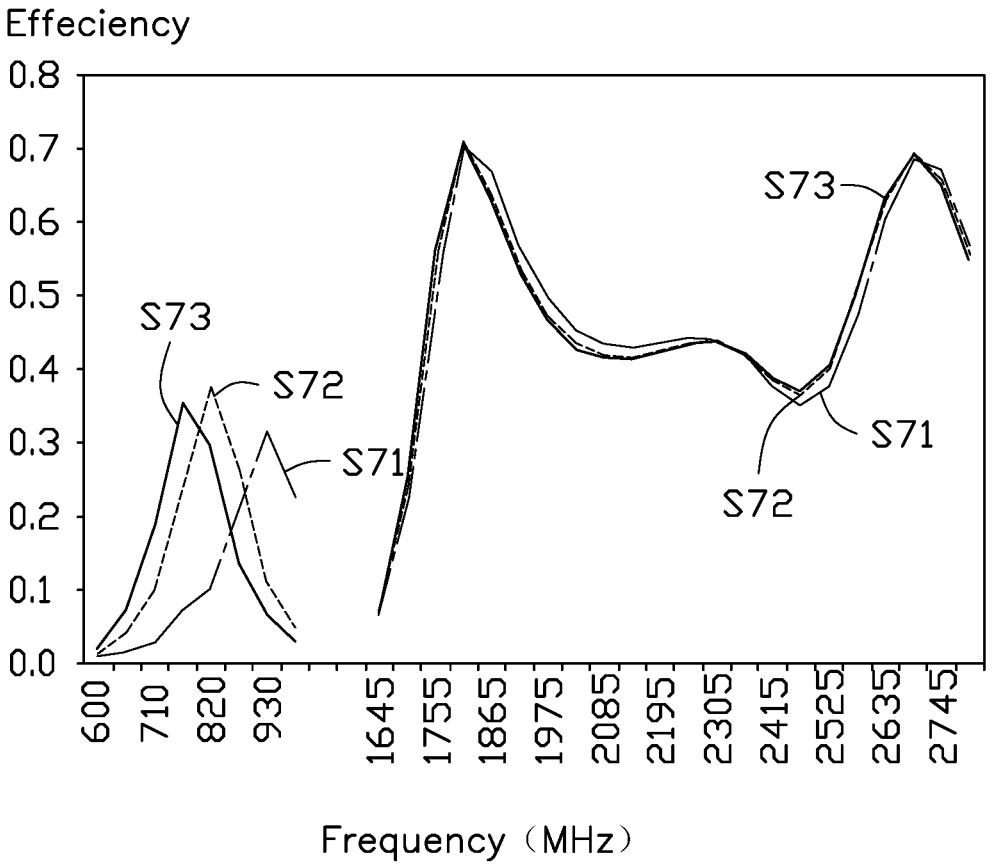
FIG. 7 is a radiating efficiency graph when the antenna structure of FIG. 2 is operating.

FIG. 7 shows a radiating efficiency graph of the antenna structure 100 in operation. The fourth inductor L4 can be adjusted with different inductances by the switch S, thus performing the different radiating efficiency curves S71, S72, S73. Curve S71 is a radiating efficiency of the antenna structure 100 in operation when the inductance of the fourth inductor L4 is switched to 20 nH. Curve S72 is a radiating efficiency of the antenna structure 100 in operation when the inductance of the fourth inductor L4 is switched to 40 nH. Curve S73 is a radiating efficiency of the antenna structure 100 in operation when the inductance of the fourth inductor L4 is switched to 60 nH.

Figure 8:
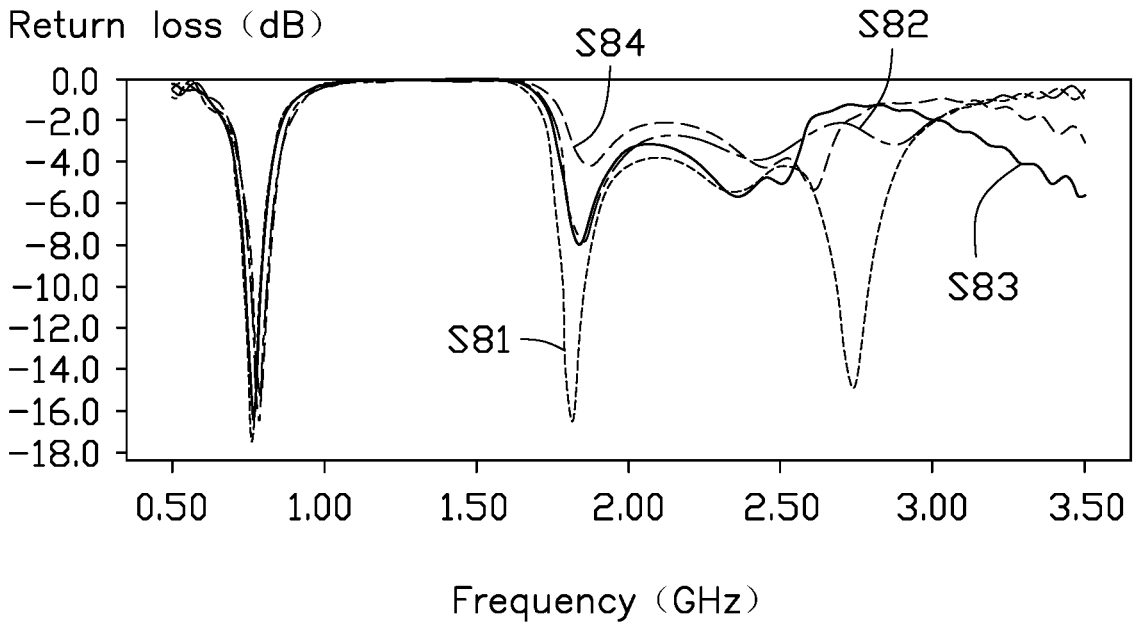
FIG. 8 is a radiating efficiency graph when the antenna structure of FIG. 2 operates in different antenna forms.

FIG. 8 shows a return loss (RL) graph when the antenna structure 100 operates through different structures. The first metallic member 11, the second metallic member 12, and the third metallic member 13 can be designed to have different forms, thus the antenna structure 100 can perform different frequency curves S81, S82, S83. Curve S81 is a return loss of the antenna structure 100 of the present embodiment in operation. Curve S82 is a return loss when first metallic member 11 is omitted from the antenna structure 100. Curve S83 is a return loss when third metallic member 13 is omitted from the antenna structure 100.

In FIGS. 6 to 8, the antenna structure 100 can work at a low frequency band, for example, LTE-A low frequency band (700-960 MHz), at a middle frequency band (1710-2170 MHz), and at high frequency bands (2300-2690 MHz). When the antenna structure 100 operates at these frequency bands, a working frequency satisfies a design of the antenna and also has a good radiating efficiency.

The antenna structure 100 has a simple structure and may completely cover multiple system bandwidths required by current communication systems. For example, the low frequency band of the antenna structure 100 can cover a range from 700 MHz to 960 MHz, the middle frequency bands of the antenna structure 100 can cover a range from 1710 MHz to 2170 MHz, and the high frequency bands of the antenna structure 100 can cover a range from 2300 MHz to 2690 MHz, which meets the antenna design requirements.

The antenna structure 100 includes the first metallic member 11, the second metallic member 12, and the third metallic member 13. The antenna structure 100 further includes the first gap 112 and the second gap 114 defined between the first metallic member 11, the second metallic member 12, and the third metallic member 13, therefore forming an integral metallic sheet without other slot, break line, and/or gap, which maintains integrity and aesthetics and achieves a preferred radiating performance.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a first metallic member;

a second metallic member spaced apart from the first metallic member, a first gap formed between the first metallic member and the second metallic member;

a third metallic member spaced apart from the first metallic member and the second metallic member, a second gap formed between the second metallic member and the third metallic member; and a feed portion, an end of the feed portion connected to an end of the second metallic member adjacent to the third metallic member, another end of the feed portion electrically connected to a feed source to feed current into the antenna structure;

wherein the first metallic member, the second metallic member, and the third metallic member are electrically grounded;

wherein the current enters the second metallic member from the feed portion, the current flows towards the first gap and the second gap respectively to excite radiation signals in a first frequency band, the first metallic member and the third metallic member obtain the current from the second metallic member by coupling to respectively excite radiation signals in a second frequency band and a third frequency band, frequencies of the third frequency band are higher than frequencies of the second frequency band, and the frequencies of the second frequency band are higher than frequencies of the first frequency band.

2. The antenna structure of claim 1, wherein the first metallic member, the second metallic member, and the third metallic member are metal sheets, a middle portion of the second metallic member defines a first opening for exposing an electronic element.

3. The antenna structure of claim 1, further comprising a first extending arm and a switching circuit, wherein an end of the first extending arm is perpendicularly connected to the second metallic member, the other end of the first extending arm is electrically connected to the switching circuit.

4. The antenna structure of claim 3, further comprising a second extending arm, wherein the third metallic member is L-shaped, an end of the third metallic member is electrically grounded and defines a second opening for exposing another electronic element; an end of the second extending arm is perpendicularly connected to an end of the third metallic member adjacent to the second metallic member, another end of the second extending arm is electrically grounded.

5. The antenna structure of claim 4, wherein the switching circuit includes a first inductor, a second inductor, a third inductor, a fourth inductor, a fifth inductor, a capacitor, and a switch; an end of the third inductor is electrically connected to the feed source, another end of the third inductor is electrically connected to an end of the first inductor, another end of the first inductor is electrically connected to the feed portion; the capacitor and the third inductor are connected in parallel, an end of the capacitor is electrically connected to the feed source, another end of the capacitor is electrically connected to the first inductor; an end of the second inductor is electrically connected to a junction of the third inductor, the first inductor, and the capacitor, another end of the second inductor is electrically grounded; an end of the fourth inductor is electrically connected to the first extending arm, another end of the fourth inductor is electrically grounded through the switch; an end of the fifth inductor is electrically connected to the second extending arm, another end of the fifth inductor is electrically grounded.

6. The antenna structure of claim 5, wherein the current flows from the feed source through the switching circuit and the feed portion and then enters the second metallic member, and flows towards the first gap and the second gap respectively, and further flows into the first extending arm, thus exciting a first resonant mode to generate radiation signals in the first frequency band, the first resonant m ode is an LTE-A (Long Term Evolution Advanced) low frequency resonant mode, while the first frequency band is a frequency band of 700-960 MHz.

7. The antenna structure of claim 6, further comprising a ground portion, wherein an end of the ground portion is perpendicularly connected to an end of the first metallic member away from the second metallic member, another end of the ground portion is electrically grounded; the first metallic member obtains the current from the second metallic member by coupling, the current flows through the first metallic member and the ground portion, thus exciting a second resonant mode to generate radiation signals in the second frequency band, the second resonant mode is an LTE-A middle frequency resonant mode, the second frequency band is a frequency band of 1710-2170 MHz.

8. The antenna structure of claim 7, wherein the third metallic member obtains the current from the second metallic member by coupling, the current flows through the third metallic member and the second extending arm, thus exciting a third resonant mode to generate radiation signals in the third frequency band, the third resonant mode is an LTE-A high frequency resonant mode, the third frequency band is a frequency band of 2300-2690 MHz.

9. The antenna structure of claim 8, wherein the fourth inductor includes a plurality of impedances, the switch is configured to switch the second metallic member to different impedances of the fourth inductor to move the first frequency band towards higher or lower frequencies, the frequencies of the third frequency band of the third metallic member are determined based on the fifth inductor, the second inductor and the capacitor form a high-pass matching circuit to broaden a bandwidth of the first frequency band; the frequencies of the second frequency band of the first metallic member are determined based on the first inductor and the third inductor.

10. The antenna structure of claim 9, wherein a width of each of the first gap and the second gap is in a range from 0.5 to 5 millimeters, a width of a keep-out area of the antenna structure is 3 millimeters.

11. A wireless communication device, comprising:

an antenna structure, the antenna structure comprising:

a first metallic member;

a second metallic member spaced apart from the first metallic member, a first gap formed between the first metallic member and the second metallic member;

a third metallic member spaced apart from the first metallic member and the second metallic member, a second gap formed between the second metallic member and the third metallic member; and a feed portion, an end of the feed portion connected to an end of the second metallic member adjacent to the third metallic member, another end of the feed portion electrically connected to a feed source to feed current into the antenna structure;

wherein the first metallic member, the second metallic member, and the third metallic member are electrically grounded;

wherein the current enters the second metallic member from the feed portion, the current flows towards the first gap and the second gap respectively to excite radiation signals in a first frequency band, the first metallic member and the third metallic member obtain the current from the second metallic member by coupling to respectively excite radiation signals in a second frequency band and a third frequency band, frequencies of the third frequency band are higher than frequencies of the second frequency band, and the frequencies of the second frequency band are higher than frequencies of the first frequency band.

12. The wireless communication device of claim 11, wherein the first metallic member, the second metallic member, and the third metallic member are metal sheets and a portion of an external frame structure of the wireless communication device; a crosswise direction of the first metallic member, the second metallic member, and the third metallic member is a thickness direction of the wireless communication device; a lengthwise direction of the first metallic member, the second metallic member, and the third metallic member is a width direction of the wireless communication device; a middle portion of the second metallic member defines a first opening for exposing an electronic element.

13. The wireless communication device as claim 11, wherein the antenna structure further comprises a first extending arm and a switching circuit, an end of the first extending arm is perpendicularly connected to the second metallic member, the other end of the first extending arm is electrically connected to the switching circuit.

14. The wireless communication device as claim 13, wherein the antenna structure further comprises a second extending arm, the third metallic member is L-shaped, an end of the third metallic member is electrically grounded and defines a second opening for exposing another electronic element; an end of the second extending arm is perpendicularly connected to an end of the third metallic member adjacent to the second metallic member, another end of the second extending arm is electrically grounded.

15. The wireless communication device as claim 14, wherein the switching circuit includes a first inductor, a second inductor, a third inductor, a fourth inductor, a fifth inductor, a capacitor, and a switch; an end of the third inductor is electrically connected to the feed source, another end of the third inductor is electrically connected to an end of the first inductor, another end of the first inductor is electrically connected to the feed portion; the capacitor and the third inductor are connected in parallel, an end of the capacitor is electrically connected to the feed source, another end of the capacitor is electrically connected to the first inductor; an end of the second inductor is electrically connected to a junction of the third inductor, the first inductor, and the capacitor, another end of the second inductor is electrically grounded; an end of the fourth inductor is electrically connected to the first extending arm, another end of the fourth inductor is electrically grounded through the switch; an end of the fifth inductor is electrically connected to the second extending arm, another end of the fifth inductor is electrically grounded.

16. The wireless communication device as claim 15, wherein the current flows from the feed source through the switching circuit and the feed portion and then enters the second metallic member, and flows towards the first gap and the second gap respectively, and further flows into the first extending arm, thus exciting a first resonant mode to generate radiation signals in the first frequency band, the first resonant mode is an LTE-A (Long Term Evolution Advanced) low frequency resonant mode, while the first frequency band is a frequency band of 700-960 MHz.

17. The wireless communication device as claim 16, wherein the antenna structure further comprises a ground portion, an end of the ground portion is perpendicularly connected to an end of the first metallic member away from the second metallic member, another end of the ground portion is electrically grounded; the first metallic member obtains the current from the second metallic member by coupling, the current flows through the first metallic member and the ground portion, thus exciting a second resonant mode to generate radiation signals in the second frequency band, the second resonant mode is an LTE-A middle frequency resonant mode, the second frequency band is a frequency band of 1710-2170 MHz.

18. The wireless communication device as claim 17, wherein the third metallic member obtains the current from the second metallic member by coupling, the current flows through the third metallic member and the second extending arm, thus exciting a third resonant mode to generate radiation signals in the third frequency band, the third resonant mode is an LTE-A high frequency resonant mode, the third frequency band is a frequency band of 2300-2690 MHz.

19. The wireless communication device as claim 11, further comprising a circuit board and a USB (Universal Serial Bus) connector, wherein the first metallic member, the second metallic member, and the third metallic member are arranged separately on an end of the circuit board and electrically connected to the circuit board; the USB connector is arranged on a middle portion of the end of the circuit board; the first metallic member, the second metallic member, and the third metallic member are arranged in a bottom portion of the wireless communication device; the first metallic member and the third metallic member are in opposite ends of the bottom portion, and the second metallic member is in middle of the bottom portion of the wireless communication device.

20. The wireless communication device as claim 19, wherein a middle portion of the second metallic member defines a first opening, the USB connector exposes from the wireless communication device through the first opening, the antenna structure further comprises a first extending arm adjacent to and spaced from the USB connector.

* * * * *